US006003357A

United States Patent [19]

Brown

[11] Patent Number: 6,003,357

[45] Date of Patent: Dec. 21, 1999

[54] SHEET METAL BRAKE ACCESSORY

[76] Inventor: Roy D. Brown, 2339 Three Mile Run Rd., Perkasie, Pa. 18944

[21] Appl. No.: 09/030,771

[22] Filed: Feb. 26, 1998

Related U.S. Application Data

[60] Provisional application No. 60/040,729, Mar. 12, 1997.

[51] Int. Cl.[6] ..... B21D 5/04

[52] U.S. Cl. ..... 72/321; 72/319

[58] Field of Search ..... 72/319–321, 293, 72/316

[56] References Cited

U.S. PATENT DOCUMENTS

| | | | |
|---|---|---|---|
| 348,423 | 8/1886 | Shackleton | 72/321 |
| 1,033,309 | 7/1912 | Fisher | 72/321 |
| 2,028,869 | 1/1936 | Jensen | 72/319 |
| 2,132,569 | 10/1938 | Kelleher | 72/319 |
| 2,302,958 | 11/1942 | Jensen | 72/319 |
| 2,767,762 | 10/1956 | Peterson . | |
| 3,592,037 | 7/1971 | Cleaver | 72/319 |
| 3,913,370 | 10/1975 | Break | 72/319 |
| 4,389,869 | 6/1983 | Van Cleave | 72/319 |
| 5,819,577 | 10/1998 | D'Arcy | 72/321 |

FOREIGN PATENT DOCUMENTS

| | | | |
|---|---|---|---|
| 14364 | 5/1934 | Austria | 72/321 |
| 779755 | 7/1957 | United Kingdom | 72/319 |

*Primary Examiner*—Daniel C. Crane
*Attorney, Agent, or Firm*—Gregory J. Gore

[57] ABSTRACT

An accessory for a bending brake is secured to the brake only by the clamping force of the brake jaws. A pressing member is rotatably affixed to the base plate which is clamped between the jaws when in operation. A pressing member is attached to the base plate by hinge joints and a linkage, including slotted links which permit the metal sheet to be forcibly pressed against and rolled over the surface of a curved die, ensuring a smooth and even curve surface in the resulting workpiece. The die form is affixed to the front edge of the base plate. The base plates may be interchanged to include different diameter die forms for varying the radius of the executed bend. The location of the die at the front edge of the base plate permits the formation of accurate, smooth curves in sheet metal workpieces in angles of 90-degrees or greater.

9 Claims, 6 Drawing Sheets

10
13
15
17
19

SHEET METAL BRAKE ACCESSORY

Priority based upon Provisional Patent Application Ser. No. 60/040,729 with a filing data of Mar. 12, 1997, entitled "Sheet Metal Brake Accessory", is hereby claimed.

FIELD OF THE INVENTION

The present invention relates to a sheet metal brake of the type used to form home aluminum siding. More specifically, it relates to an accessory for a sheet metal brake which facilitates the formation of curved bends in a sheet metal panel.

BACKGROUND OF THE INVENTION AND DESCRIPTION OF PRIOR ART

Portable sheet metal bending brakes are commonly used in the home construction industry for the formation of aluminum sheet metal siding panels. Bending brakes of this type are typically portable so that individual panels may be formed on site. Primarily, the brakes are used to form corner bends in the aluminum sheets which are typically 90-degree angles. As the bend is formed, the sheet metal on either side of the angled bend is flat and straight. There is a need in the home construction industry, however, for the capacity to form curved bends in the sheet metal, such as may be required to form rain gutters or decorative crown molding strips.

The closest patent prior art of which the applicant is aware is U.S. Pat. No. 2,767,762 issued to Peterson on Oct. 23, 1956. This patent discloses an attachment for sheet metal bending brakes which enables the brake to form rounded bends in sheet metal by the use of a die which is rigidly clamped to the frame of the brake. A hinged pressing member is bolted to the jaw of the brake. After the sheet metal piece is firmly clamped between the jaws, the hinged member is pulled down over the top of the sheet which is thereby pressed against the curved surface of the die, thus forming a curved bend in the sheet.

While the Peterson device may be used to form curved bends in a metal sheet, the jaw must be modified to carry the bolted-on hinged pressing member and, similarly, the frame must be modified to carry the clamped die. The Peterson attachment may be disassembled and unbolted between uses, but its attachment and removal is time-consuming and cumbersome. Furthermore, the entire weight of the hinged pressing member is continuously carried by the movable top jaw which makes it cumbersome to use. Finally, because the Peterson pressing member pivots on a fixed axis, it only contacts the sheet at one point and there is no direct pressure applied along the surface of the die, making the formation of smooth bends difficult.

U.S. Pat. No. 3,913,370 issued to Break on Oct. 21, 1975 discloses a bending attachment for a portable sheet metal brake in which the attachment enables the operator to enlarge the bending range of the brake. The attachment disclosed in this reference is held to the brake only by the clamping pressure of the jaw while it is being used.

There is therefore a need in the art for a bending brake attachment which may be used to easily form smooth, rounded bends in sheet metal which is easily detachable, may be universally applied to different bending brakes, and which requires no modification to the brake on which it is used.

SUMMARY OF THE INVENTION

In order to meet the needs in the art, the present invention has been devised. An accessory for a bending brake has been created which is secured only by the pressing force of the jaw. There are no structures attached to any part of the brake, including the jaw, which may thus move freely and unencumbered. Furthermore, the present apparatus includes a pressing member with hinge joints connected by slotted links which permit the sheet to be forcibly pressed against and rolled over the surface of a curved die form, ensuring a smooth and even curved surface in the resulting workpiece.

The slots in the links are dimensioned such that the articulated and sliding interconnection between the base plate and pressing plate allows bends up to 180-degrees to be formed. The length of the slots further provide a stop which limits the possible over application of a bend. By the articulation of the pressing plate permitted by the slotted arms, the plate is free to slide across the surface of the sheet as it is rolled over the top of the die. This allows the sheet to be pressed firmly between the pressing plate and the die at all points along the die's curved outer surface. In order to provide the greatest bend angle, the entire curved die is preferably positioned above the plane between the clamping jaw and the anvil.

Because the complete bending brake accessory of the present invention is held to the brake only by the clamping jaw, it may be easily released and removed in a matter of seconds. Furthermore, it requires no modification to the brake on which it is used and it may be used universally on any bending brake so long as there is sufficient clearance above the lip of the jaw. Finally, the different base plates which hold different diameter die forms for varying the radius of the bend may be easily substituted because the slotted links are easily detached by removable hinge pins. The present invention permits the formation of accurate, smooth curves to be formed in sheet metal workpieces in angles of 90-degrees or greater as desired.

More specifically, the applicant has invented an attachment for a sheet metal brake, comprising: a base plate with a die affixed thereto at a front edge thereof; a first shackle affixed to the base plate at a rear edge thereof; a pressing plate having a second shackle affixed to the bottom thereof hingeably connected to the base plate through a linkage; and linkage comprising a first pivot joint at one end of the link affixing the linkage to one side of the base plate, a second pinned pivot joint at an opposite end of the link providing a pivotable connection to the pressing plate, and at least one of said pivot joints including a pin slidable within a slot in the link. The base plate has opposing top and bottom parallel planar surfaces for being received within jaw of the sheet metal brake, the attachment means being secured to the brake during operation only by the clamp force of the jaws. The bending attachment further includes a second linkage identical to the first linkage, the second linkage being connected to an opposite side of the base plate from the first linkage. The resilient means, a spring, biases the first and second pivot joints toward each other, the resilient means connected to and traveling between pivot pins at opposite ends of the link. A handle is affixed to the back side of the pressing plate, centered between the left and right sides thereof. When a metal sheet is clamped against the attachment between the jaws of the brake, pulling the handle forward and downward provides the application of both pressing and pulling forces against the sheet metal as it is bent between the pressing plate and the die.

Other objects, advantages and novel features of the invention will become apparent from the following detailed description of the invention when considered in conjunction with the accompanying drawings.

BRIEF DESCRIPTION THE DRAWINGS

BRIEF DESCRIPTION OF THE PREFERRED EMBODIMENT

Figure 1:
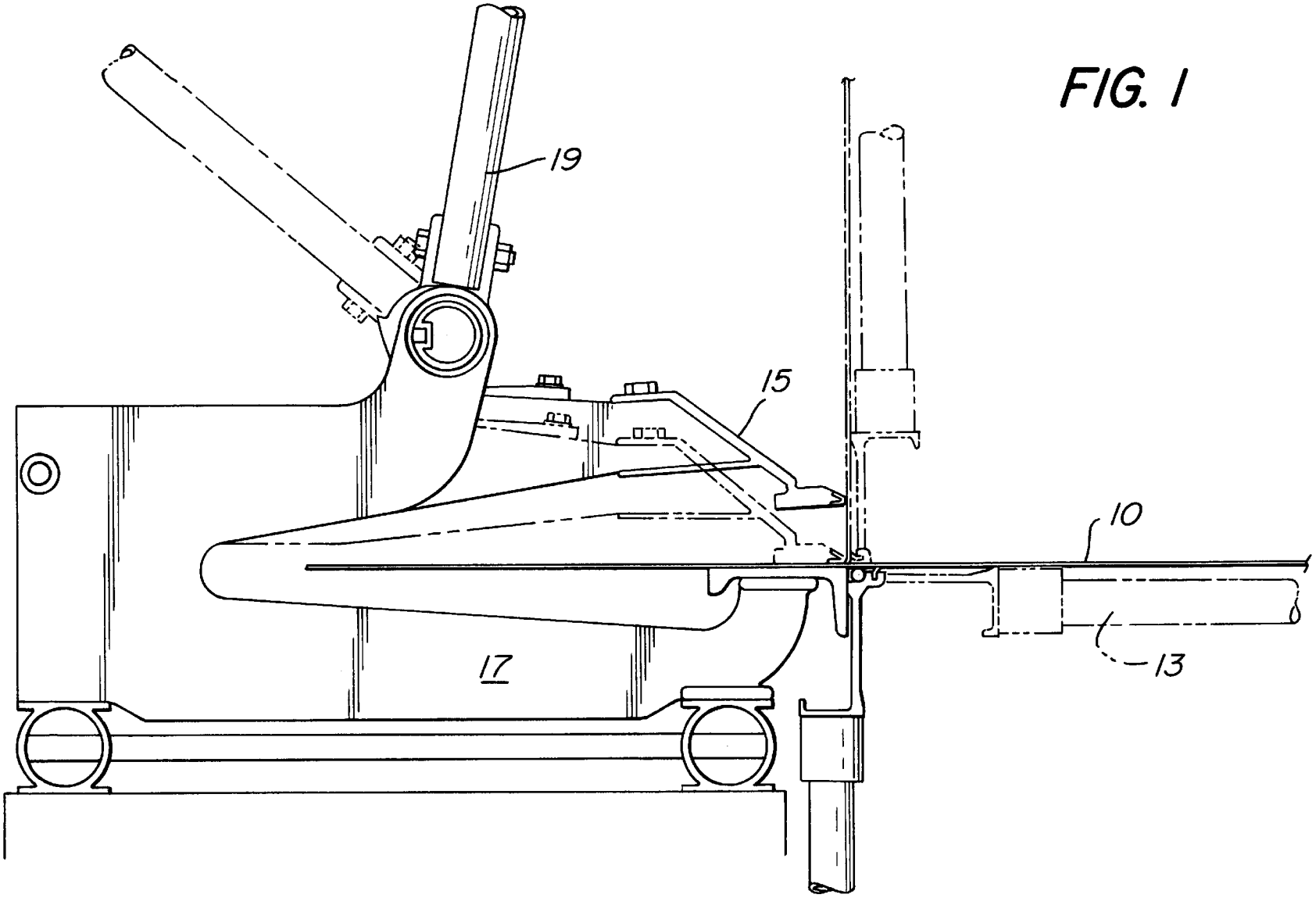
FIG. 1 is a side elevational view of a prior art bending brake with the upper movable jaw shown in alternate clamped positions in phantom lines.

Referring now to FIG. 1, a prior art bending brake of the type well-known in the arts is shown. Jaw 15 is displaced toward and away from clamping engagement with anvil 17 by movement of bar 19. Planar metal sheet 10 is clamped under the jaw and when handle 13 is moved from the horizontal position to the vertical position, the sheet is forced upward, thus creating a 90-degree bend at the nip between clamping jaw 15 and the brake anvil 17.

Figure 2:
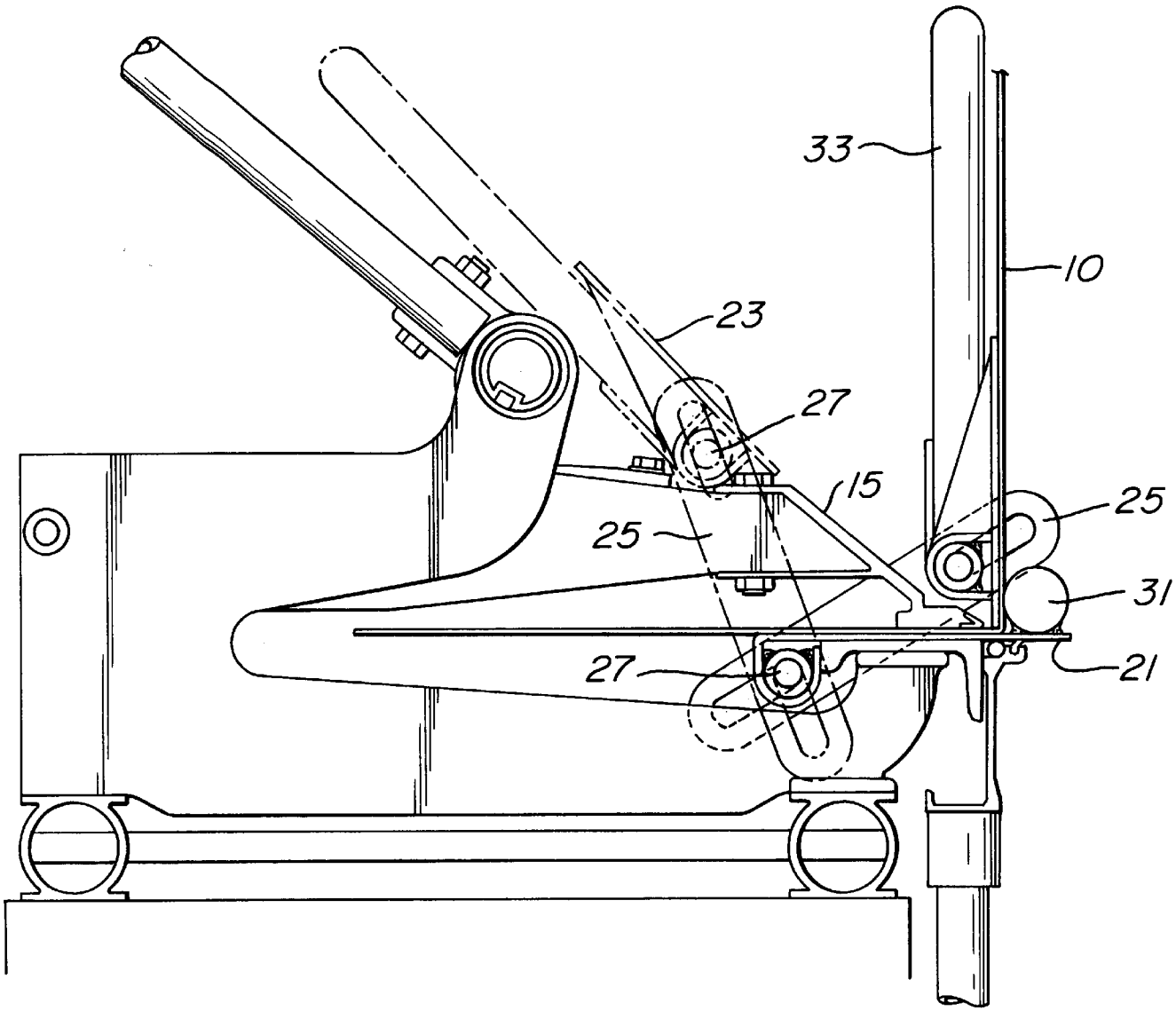
FIG. 2 is a side elevational view of the present invention installed into a brake shown in FIG. 1 and its non-operational at-rest position shown in phantom lines.

FIG. 2 shows the attachment which forms the subject of this invention, comprising the following elements: a base in the nature of a planar support plate 21, a pressing plate 23, right and left side linkages 25 which are attached to both the base and the pressing plate through pin connections 27, a handle 33, and a die 31. As shown in this figure, the accessory of the present invention is depicted set into the brake after the first 90-degree bend has been formed as shown in FIG. 1. Base 21 is clamped beneath jaw of the brake under sheet 10. When its application against sheet 10 begins, it is moved down against the sheet at the interior angle of the 90-degree bend into the position shown in solid lines in this figure. Formation of the curved surface in sheet 10 begins at this point by pressing the sheet against die 31 and by continuing to pull handle 33 forward. Also shown in phantom lines in this figure is the pressing plate retracted and resting on the top surface of the jaw 15 which may be conveniently placed in this position when not in use. The present device is not attached to the brake in any way and is held in position during the bending operation solely by the clamping force of jaw 15.

Figure 3:
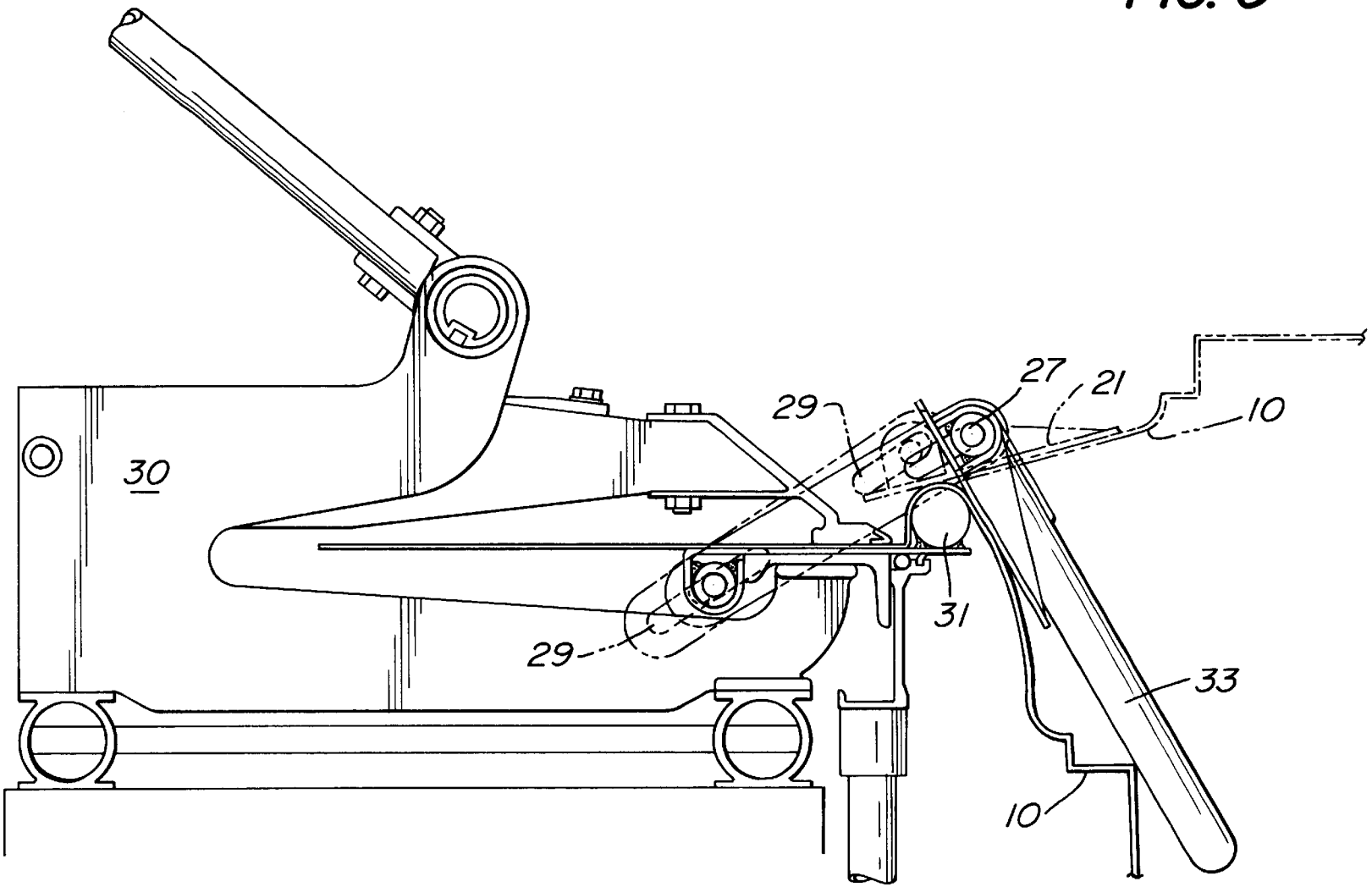
FIG. 3 is a side elevational view showing the operation of the present invention against a workpiece with an intermediate position of its operation shown in phantom lines.

Referring to FIG. 3, advanced positions of the present invention placed into pressing brake 30 forming a curved bend in the workpiece are shown. At an intermediate position shown in phantom lines, the pressing plate 21 has moved over the surface of the sheet metal 10, pressing it directly against die 31. Later, in its most advanced position, handle 33 has been moved to a position where it is pressing the sheet metal against the die at a point through almost 180-degrees around the circular die from the beginning of the bend. At this point, the hinge pin 27 has moved so that the ends of the slots of the link arms restrict any further movement at the pressing plate 21. In this way, the length of the slots 29 in the links determine the extent of the bend that may be formed. Thus, the dimensions of the links can be selected to provide a convenient stop preventing over-application of pressing plate.

Figure 4:
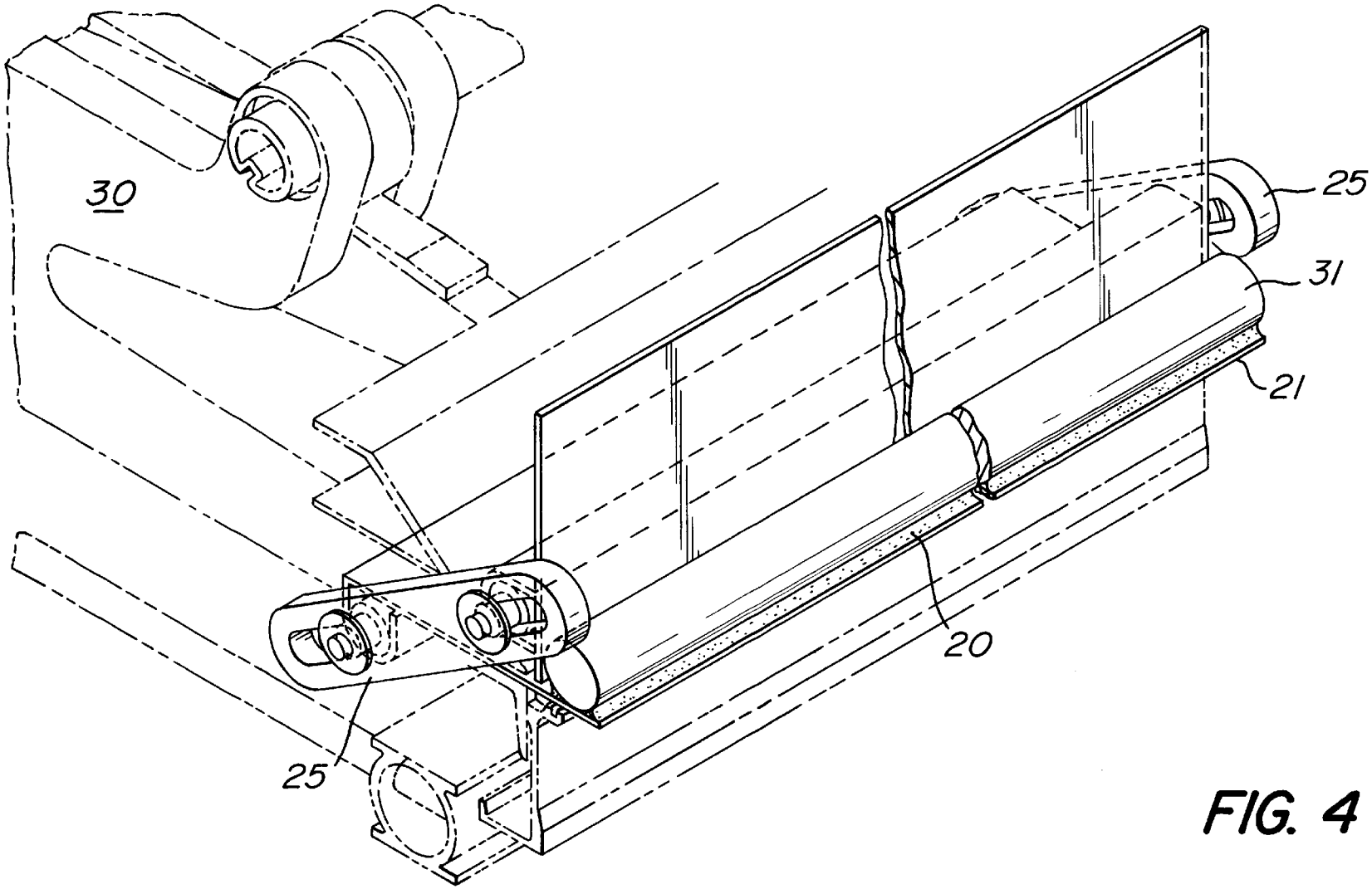
FIG. 4 is a top left front isometric view of the present invention shown installed in a sheet metal bending brake which is shown in dotted lines.
Figure 5:
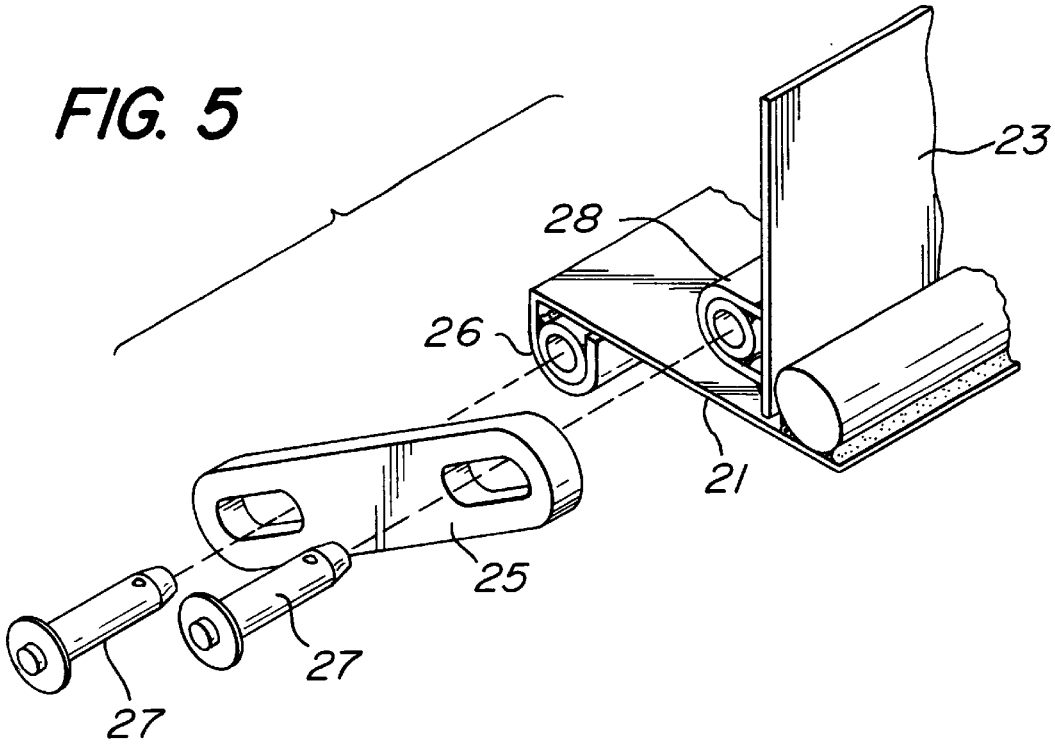
FIG. 5 is a top left front partial cutaway exploded view of the present invention.

Referring to FIG. 4, a view of the present invention inserted into a pressing brake 30 shows that the connecting linkage 25 shown in FIG. 5 is provided symmetrically on both sides of the bending brake accessory. Die 31 is located at the front edge of base plate 21 secured thereto by welding 20. When close tolerances between the hinge pins and slotted links are provided, the present device permits the pressing brake to maintain its lateral alignment while it is pulled over the top of the die. The pressing plate is able to roll over and against the curved surface of the die form due to the pivoting and sliding joint provided by the slotted links. In the preferred embodiment of the invention, the links comprise elongate arms having two slots. Each link is connected to the base and the pressing plate by two pivot pins, which extend through the slotted links and are attached to shackles affixed at either end to both the base and the pressing plate in the manner shown in FIG. 5. By these mechanical relations, an articulated, sliding joint is created which permits the pressing plate to roll smoothly and continuously over the curved surface of the die.

Referring now to FIG. 5, a partial cutaway view of the present invention is shown. Base 21 is connected to pressing plate 23 by way of slotted link arm 25. Pins 27 are fitted through slots in the link arm and into shackle 26 of the base at one end of the linkage and shackle 28 of the pressing plate at the other end of the linkage.

Figure 6:
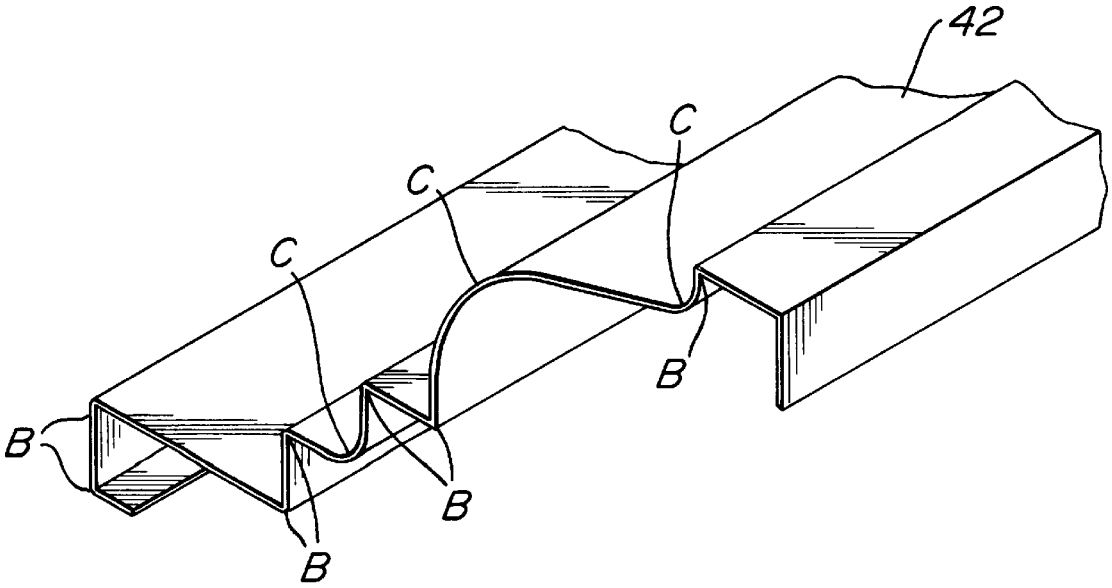
FIG. 6 is a top left front isometric cutaway view of a workpiece formed with curved surfaces utilizing the present invention.

Referring now to FIG. 6, a crown molding workpiece 42 which has been formed by use of the present invention is shown. Right-angled bends B are made as desired with the accessory of the present invention removed from between the clamping jaws and the curved bends C are made once the accessory has been re-fitted into the brake. Because the present device is not attached to the brake in any way when the clamping jaws are open, it may easily be lifted away from and reinserted between the jaws of the brake. Therefore, it may be used selectively to form the curved bends between successive right angle bends easily and efficiently. Bends having a different radius may be formed by exchanging the base plate 21 shown in FIG. 5 with another base plate (not shown) which carries a die of different diameter. The die in the illustration of the preferred embodiment has a circular form with a constant radius of curvature. However, it should be understood that die forms of any convex shape may be used and need not be restricted to those having a constant radius.

Figure 7:
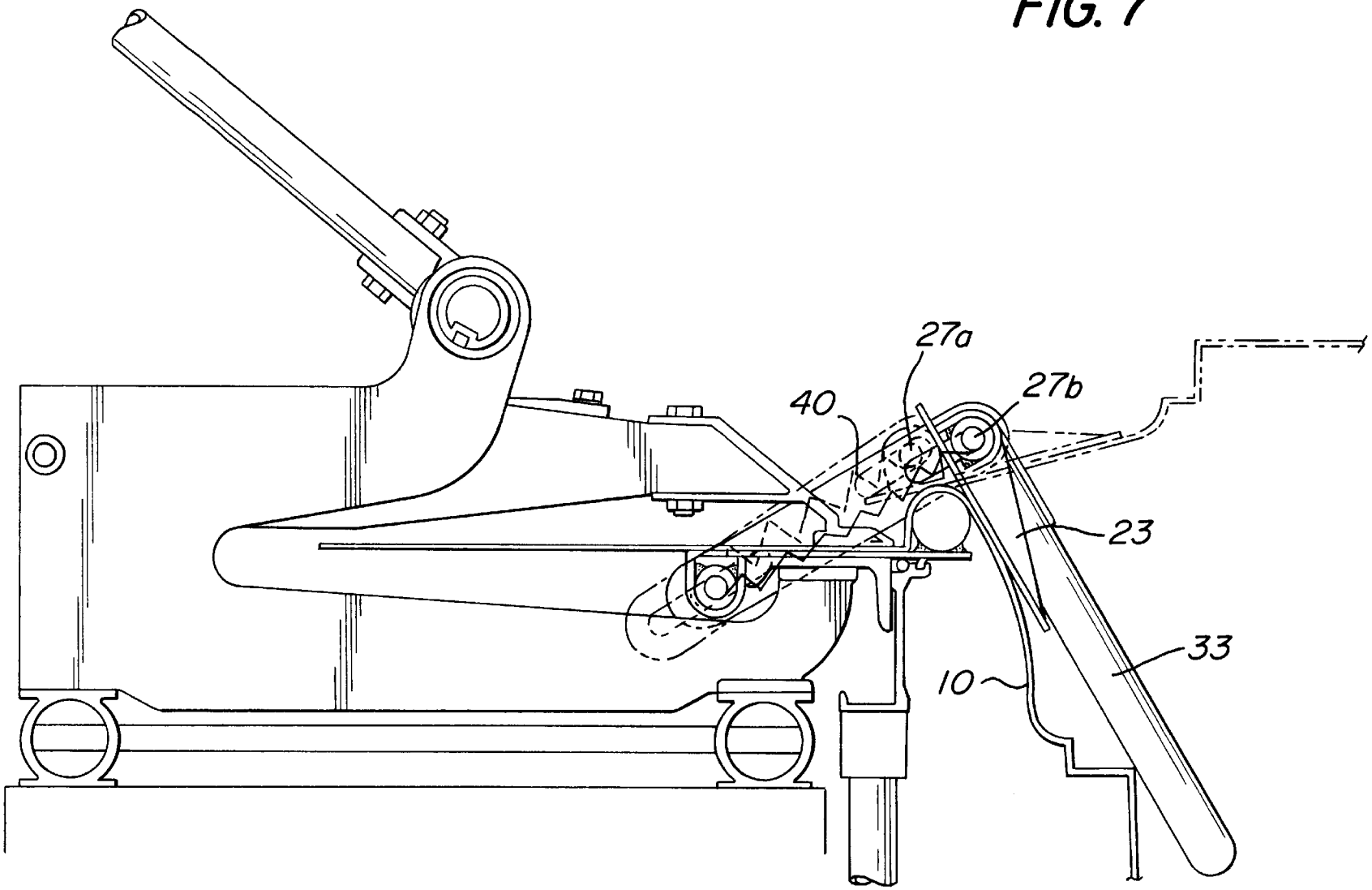
FIG. 7 is a side elevational view of an alternate embodiment showing the use of spring means between the hinge pins.

Referring to FIG. 7, an alternate embodiment of the present invention is shown which includes the addition of spring means 40 that applies a resilient force between the hinge pins. As the pressing plate pin moves from position 27*a* to 27*b*, the spring means 40 lengthens, and therefore applies a restorative force against the movement of the pressing plate as it is advanced. The spring 40 adds control to the operation of the present invention and enables the force applied by handle means 33 to be transmitted against sheet 10 at the point of contact with pressing plate 23.

OPERATION OF THE INVENTION

The invention operates as follows. The bending accessory is placed on the anvil of the brake. A strip of sheet metal is then placed over the base of the device and under the jaw of the sheet metal brake. The sheet metal and the base plate of the invention are then clamped under the jaw of the sheet metal brake so that neither the sheet metal nor the base can shift position during the bending operation.

Once the sheet metal and the base are clamped by the sheet metal brake, the pressing plate is moved down so that it compresses the sheet metal against the die along the surface of the die. The handle is then pulled forward to roll the pressing plate over the curved surface of the die and thereby compressing the sheet metal of the die to form a smooth, continuously curved bend as the handle is pulled forward. Additional downward force should also be directly applied manually to the pressing plate. As this occurs, the pressing plate forcibly slides across the surface of the sheet. This sliding force applies a tension or pulling force to the sheet to ensure a smooth bend.

The invention described above can be used with any size sheet metal brake quickly and without alteration. When the accessory is not is use, it can be removed and the sheet metal brake can then be used in the usual manner. Finally, the die portion of the invention can be replaced with other sizes and shapes of dies to form a wide variety of curves in sheet metal by interchanging bases which carry different dies.

It should be understood that the above description discloses specific embodiments of the present invention and are for purposes of illustration only. There may be other modifications and changes obvious to those of ordinary skill in the art that fall within the scope of the present invention which should be limited only by the following claims and their equivalents.

What is claimed is:

1. A bending attachment for a sheet metal brake, comprising:

a base plate having a die affixed at a front edge thereof;

a first shackle affixed to said base plate at a rear edge thereof;

a pressing plate having a second shackle affixed to a bottom thereof hingeably connected to said base plate by a linkage pinned thereto; and said linkage comprising a link having a first pivot joint at one end of said link affixing said linkage to said first shackle at one side of said base plate, a second pinned pivot joint at an opposite end of said link providing a pivotable connnection to said second shackle of the pressing plate, and at least one of said pivot joints including a pin slidable within a slot in said link.

2. The bending attachment of claim 1, wherein said base plate has opposing top and bottom parallel planar surfaces for being received within jaws of said sheet metal brake, said attachment means secured to said brake during operation only by the clamp force of said jaws.

3. The bending attachment of claim 1, further including a second linkage identical to said first linkage, said second linkage connected to an opposite side of said base plate from said first linkage.

4. The bending attachment of claim 1, further including resilient means biasing said first and said second pivot joints toward each other, said resilient means connected to and traveling between pivot pins at opposite ends of said link.

5. The bending attachment of claim 4, wherein said resilient means is a spring.

6. The bending attachment of claim 1, further including a handle affixed to a back side of said pressing plate, said handle centered between a left and a right side thereof.

7. The bending attachment of claim 6, further described in that when a metal sheet is clamped against said attachment between jaws of the brake, pulling the handle forward and downward provides the application of both pressing and pulling forces against said sheet metal as it is bent between said pressing plate and said die.

8. In combination, a bending attachment and a sheet metal brake comprising:

a sheet metal brake having jaws for clamping an article of sheet metal to be bent, said jaws being movable between open and closed positions;

an attachment for said sheet metal brake removably positioned between said jaws and in contact with said sheet metal article;

said attachment including a base plate having a die affixed at a front edge thereof;

a pressing plate hingeably connected to said base plate for applying a pressing force against said sheet metal and said die; and a shackle affixed to a bottom of said pressing plate hingeably connecting said pressing plate to said base plate by a linkage pinned thereto.

9. The combination of claim 8, wherein said linkage comprises a link having a first pivot joint at one end of said link affixing said linkage to one side of said base plate, a second pinned pivot joint at an opposite end of said link providing a pivotable connection to said pressing plate, and at least one of said pivot joints including a pin slidable within a slot in said link.

* * * * *